US005139063A

United States Patent [19]

Nettles et al.

[11] Patent Number: 5,139,063

[45] Date of Patent: Aug. 18, 1992

[54] CHIPPER SLIVER TRIMMER

[75] Inventors: Timothy P. Nettles, Carthage; Mark D. Robinson, Black River, both of N.Y.

[73] Assignee: Carthage Machine Company, Birmingham, Ala.

[21] Appl. No.: 803,428

[22] Filed: Dec. 6, 1991

[51] Int. Cl.[5] ..... B02C 18/18; B02C 7/12

[52] U.S. Cl. ..... 144/176; 144/162 R; 241/92; 241/298

[58] Field of Search ..... 144/162 R, 163, 164, 144/176, 373; 241/92, 296, 298

[56] References Cited

U.S. PATENT DOCUMENTS 2,172,449 9/1939 Pelot et al. .
3,332,461 7/1967 Ledergenber ..... 144/176
3,528,617 9/1970 Trevathan .
3,647,151 3/1972 Artiano .
4,595,150 6/1986 Aario .
4,784,337 11/1988 Nettles et al. ..... 144/176

*Primary Examiner*—W. Donald Bray
*Attorney, Agent, or Firm*—Wall and Roehrig

[57] ABSTRACT

A chipper for cutting uniform chips from a log has a sliver ring mounted on the rotary disc radially outside the cutting blade assemblies, and also has cooperating arcuate wrapper member and special sliver bedknife mounted on the front plate of the chipper housing. The wrapper member is concentric with the sliver ring and extends circumferentially around it for a distance, and also extends axially towards the disc and beyond the proximal face of the sliver ring to define a radial gap between the ring and the wrapper. The sliver bedknife extends across the face of the disc from one end of the arcuate wrapper. The sliver bedknife, the wrapper, and the sliver ring cooperate with one another to limit progression of slivers that are formed from wooden logs at the position of the stationary bedknife.

7 Claims, 4 Drawing Sheets

CHIPPER SLIVER TRIMMER

BACKGROUND OF THE INVENTION

This invention relates to disc type chippers for cutting substantially uniform chips from a log. The invention is more particularly concerned with structure on a chipper to limit the size of slivers that can form on the bedknife side of the log as it is fed into the chipper.

A chipper of this general type is described, e.g., in U.S. Pat. No. 4,784,337, which depicts a large vertical disc type chipper of the Carthage-Norman design. These chippers have a vertically disposed disc that rotates about a horizontal drive shaft mounted on a suitable base or mount, and is driven by a large electric motor. The disc is enclosed in a protective cover. Logs are introduced through a feed spout or chute into a port or opening in the cover, and contacted against the disc. In an over-shaft design, the spout or feed chute passes through an upper part of the hood portion of the cover. In an under-shaft design the spout is disposed below the shaft and introduces the logs to the cutting disc at a position beneath the shaft.

In all of these disc-type chippers, the disc has a series of generally, but not necessarily, radial cutting stations in each of which a blade assembly is positioned alongside a chip slot that passes through the disc from a proximal or feed side to a distal or discharge side. The knife assemblies are disposed with cutting edges oriented at a predetermined angle from the proximal face of the disc and the cutting edges lie in a cutting plane.

At the feed chute or spout, the rotary disc sweeps the cutting blade assemblies across the feed port in one direction, i.e., from a leading side to a trailing side. At the trailing side of the port there is a stationary bedknife. The bedknife is supported on a front frame of the machine and is housed in the cover. The trailing side of the log in the spout is positioned against the bed knife. As the disc rotates, the cutting knife assemblies are moved past the bedknife at high speed. The cutting blade assemblies rapidly cut chips from the face of the log. The chips then pass through the chip slot and are discharged at the distal side of the disc.

The bedknife has a support surface with a distal edge positioned, at least initially, a predetermined small clearance from the cutting plane of the disc knife assemblies. In operation the knifes will wear down progressively which opens the clearance somewhat.

At this position where the log is against the bedknife these chippers have a tendency to strip off a long sliver. Because the wood in the log is somewhat green and has a significant moisture content, the knife assemblies tend to flex the wood enough to bend between the disc and the bedknife. This forms the sliver which then proceeds generally horizontally between the disc and the bed knife. If unchecked, the sliver can continue for the entire length of the log, which can be a distance of twenty feet or more. The problem of slivers worsens as the clearance between the stationary bedknife and the rotary knives becomes large. These slivers, which are thin fillets of green wood ripped in the grain direction from the logs, often become balled-up and can clog the chipping machinery or associated size screening equipment.

However, to date there has been no effective means offered which prevents slivers or limits their size.

OBJECTS AND SUMMARY OF THE INVENTION

It is an object of this invention to provide a rotary disc chipper which incorporates effective means to limit size of slivers.

It is another object to provide a chipper which combats the problems of slivers, particularly when rotary knives become dull or when knife-to-bedknife clearance cannot be kept close.

According to an aspect of the invention, the chipper disc is provided with a sliver ring mounted on the proximal face of the disc and radially surrounding the cutting knife assemblies. The sliver ring also has a generally cylindrical circumferential surface. An arcuate wrapper member is mounted on a front plate of the cover, and is concentric with the disc and sliver ring. The wrapper member extends circumferentially a predetermined distance from an angular position that corresponds to the position of the stationary bedknife. The wrapper also extends distally beyond the plane of the sliver ring proximal face and proceeds axially at least a short distance along the circumferential surface so as to define a small radial gap of a predetermined clearance. A sliver bedknife also mounted on the cover front plate extends from the wrapper across at least a portion of the disc in a position to intercept and trim at that location all progressing slivers. The sliver bedknife has a distal edge disposed substantially at a small predetermined clearance from the cutting plane of the disc knife assemblies.

With this arrangement, the sliver bedknife and the wrapper cooperate with the sliver ring and the knife assemblies to limit the growth of the slivers. The end of the sliver will reach the wrapper or sliver bedknife, and cause it to buckle or twist. When this happens, the rotating knives can cut it at the main, stationary bedknife, limiting its maximum length to the space between the main stationary bedknife and the sliver bedknife. Additionally, the sliver bedknife can then cut up this piece before it finds its way through the disc chip slot. This bedknife also can, in cooperation with disc knives, trim, slivers, ends into short pieces equal to that length of sliver being formed at the main bedknife. This will equal the chip size.

In an example of a vertical disc chipper that embodies this invention, the sliver bed knife is spaced about six to twenty-four inches after the main stationary bedknife. In the case of a shaft over spout chipper, the sliver bed knife may also be disposed vertically.

The above and many other objects, features, and advantages of this invention will present themselves to those skilled in the art from the ensuing description of a preferred embodiment, when read in conjunction with the accompanying Drawing.

DETAILED DESCRIPTION OF THE PREFERRED EMBODIMENT

Figure 1:
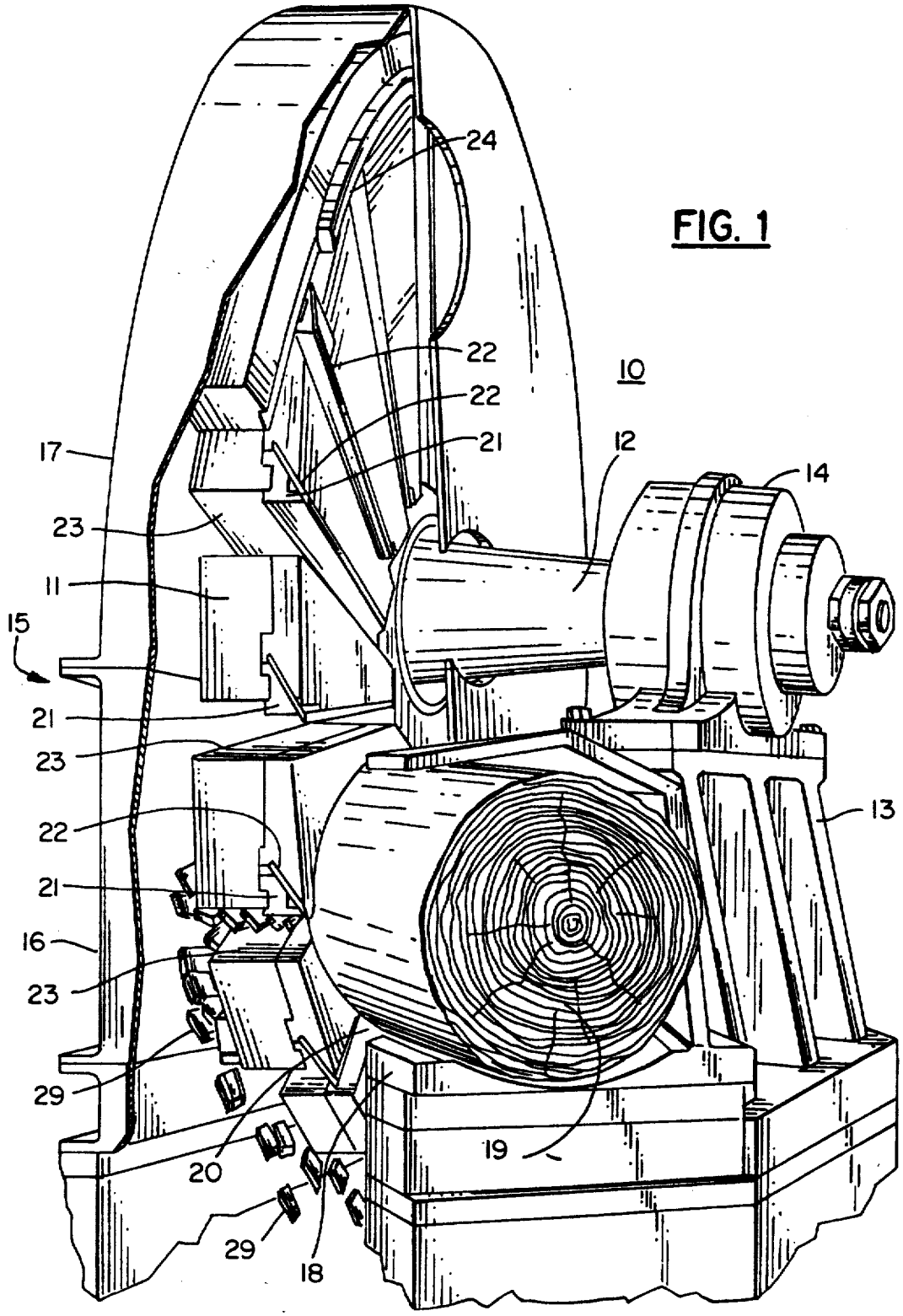
FIG. 1 is a perspective view of a vertical disc type chipper for cutting chips from a log and which embodies the concepts of the present invention.

With reference to FIG. 1 of the drawing, a large disc-type log chipper 10 of the well-known Carthage-Norman design has a vertically disposed rotary disc 11 that is rotated upon a horizontal drive shaft 12. The shaft is supported on a mount 13 in a suitable heavy-duty bearing 14. A motor (not shown) rotates the disc. The disc is shielded by a cover 15, of which there is a lower fixed portion 16 and a removable hood 17 covering an upper portion of the disc. The illustrated chipper 10 is of the shaft-over-spout design, with a feed spout or chute 18 disposed at an angle below the shaft 12. A log 19 or stick is shown progressing through the spout 18 and through a feed port 20 so that the end of the log is continuously held against the proximal, cutting face of the disc 11.

Figure 2:
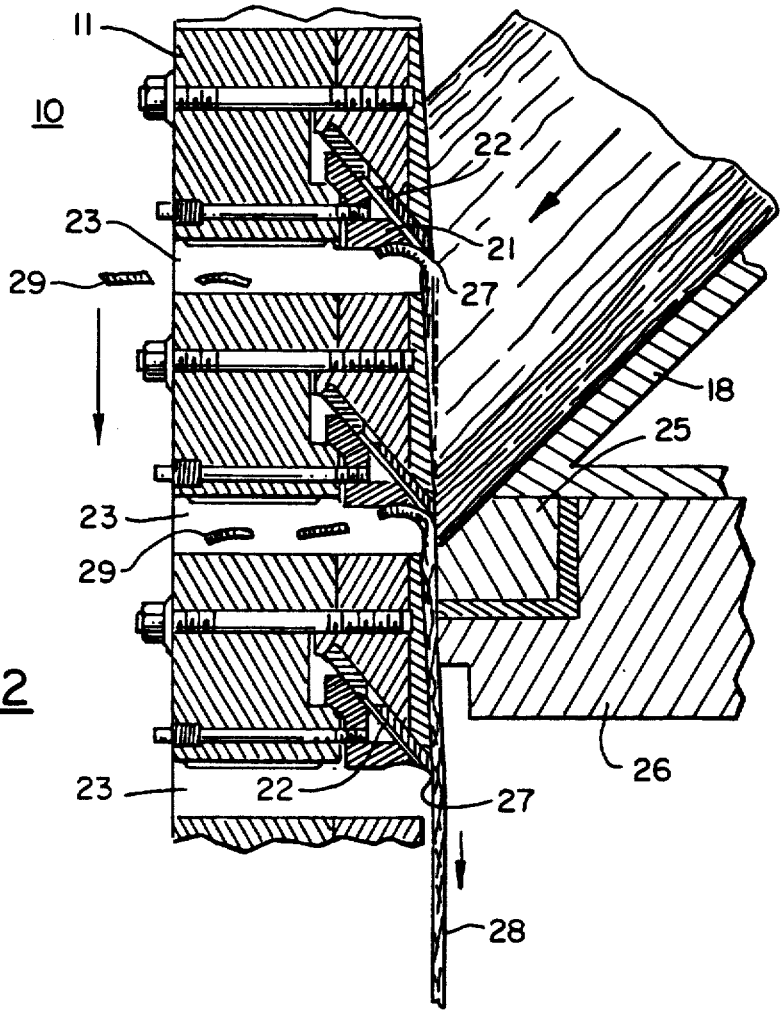
FIG. 2 is a partial sectional view taken through the disc of the chipper, and illustrating formation of a sliver from a log or stick as it encounters the cutting knives of the chipper.

As shown also with reference to FIG. 2, on the disc there are a predetermined number of generally-radially disposed cutting stations 21, each with an elongated knife assembly 22 situated adjacent a chip slot 23 that passes axially through the disc 11. Arrangements of this type are described in more detail, for example, in U.S. Pat. No. 4,784,337.

A sliver ring 24, a portion of which is shown in FIG. 1, is disposed radially beyond the ends of the knife assemblies 22. The ring 24 will be described in more detail shortly.

As also shown in FIG. 2, there is a stationary bedknife 25 situated at the trailing side of the feed port 20, and supported in a front frame 26 of the chipper 10. The bedknife 25 has a distal edge that is spaced by a small clearance, e.g. 0.020 inches to 0.060 inches, for example, from a predetermined plane at which the cutting edges 27 of the knife assemblies are disposed.

As shown in FIG. 2, when the disc 11 rotates across the feed port 20 of the spout 18 from a leading edge to a trailing side thereof, the cutting knife assemblies 22 move past the bedknife 25 at high speed. Chips are rapidly cut from the face of the log 19. These chips are directed into the associated chip slots 23, and then the chips pass out the distal or discharge side of the disc 11, and are exhausted into a discharge chute (not shown) and pass from the machine.

Because the log 19 that is fed into the spout 18 can be somewhat flexible, especially if it is rather green, a long fillet or sliver 28 is ripped from the part of the log where the knife assemblies are tangent to the log, i.e. where the blades leave the log. The slivers 28 become especially prevalent when there is a considerable gap between the bedknife 25 and the knife edges 27. The slivers 28 can extend the entire length of the log 19, i.e., 25 to 50 feet. Often these slivers will become balled-up and can clog the machinery or size screening equipment downstream of the chipper 10. As the knives wear, the clearance opens between the knife edges 27 and the bedknife 25 and the sliver problem increases.

Normally, these slivers 28 proceed along a line parallel to the spout's projection onto the disc face, i.e., in the direction normal to tangency where the knives leave the log. Because the wood is green, and very flexible and resilient, and because the wood grain runs lengthwise through the sliver 28, the knife assemblies 22 do not cut through the sliver. The sliver ring 24 assemblies 22 do not cut through the sliver. The sliver ring 24 helps somewhat to stop the progress of the slivers 28. However, when the cutting knives or bedknife become worn, the slivers can be too large for the sliver ring to be effective.

Figure 4:
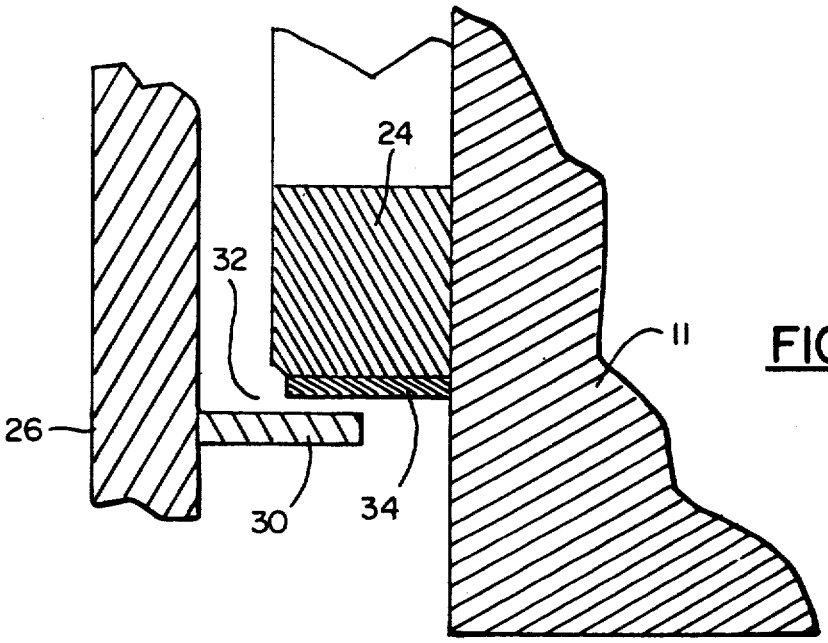
FIG. 4 is a sectional view taken at 4—4 of FIG. 3.
Figure 3:
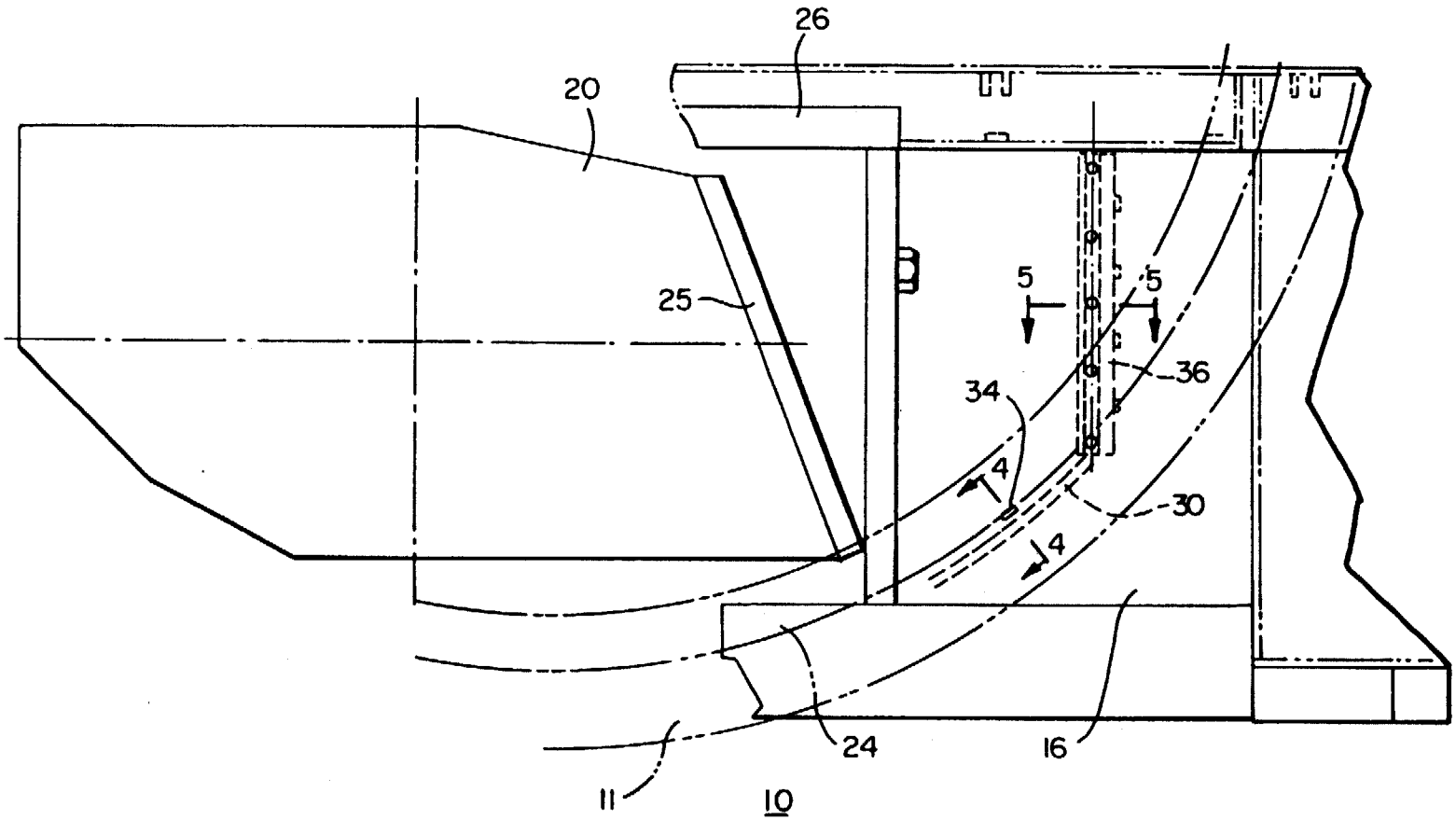
FIG. 3 is a partial elevational schematic view illustrating the position of an arcuate wrapper and sliver bedknife of one embodiment of this invention.
Figure 5:
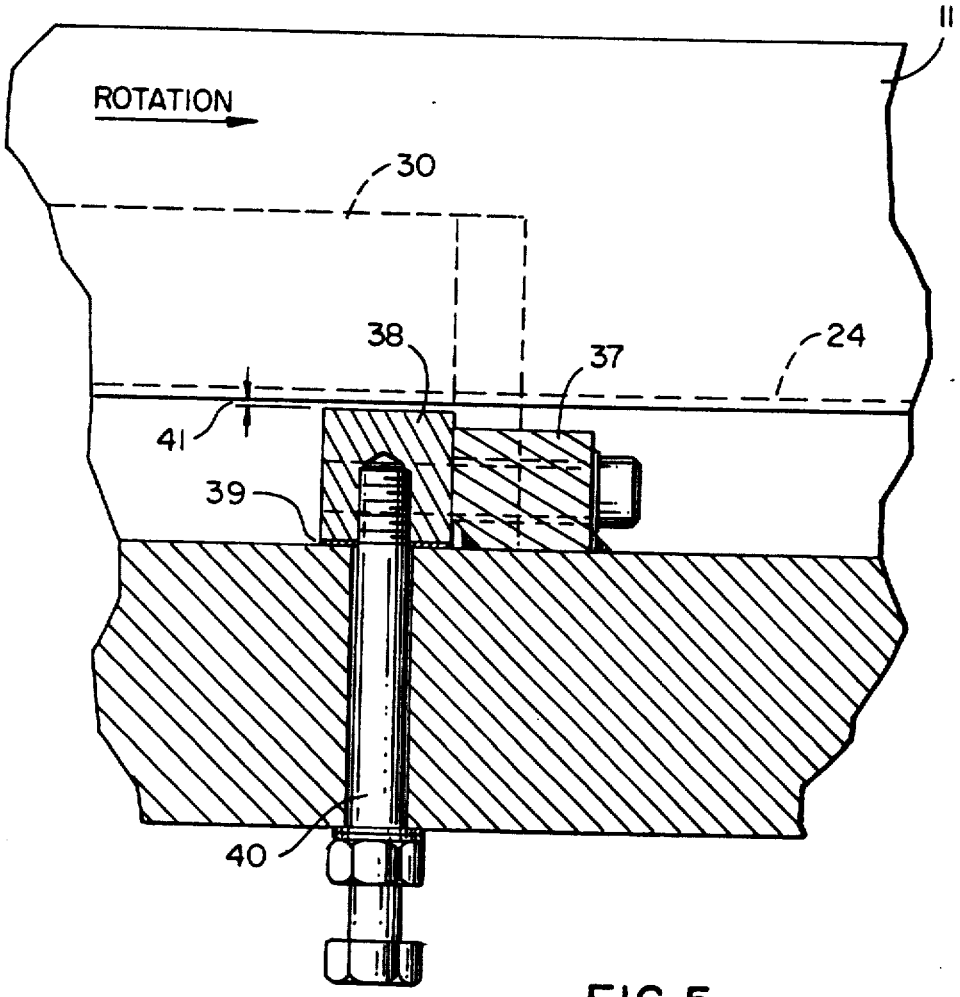
FIG. 5 is a sectional view taken at 5—5 of FIG. 3.

As shown in FIGS. 3–5, additional structures provided attached to the cover lower portion 16 to cooperate with the sliver ring 24 to block the progress of the slivers 28. An arcuate wrapper member 30, shown in FIG. 3, extends in a predetermined arc from a point below a lower end of the bedknife 25 and continues for a distance along the upturning side of the disc 11. The wrapper member 30 is attached to the cover, more specifically to the front frame 26. The wrapper member 30 extends axially for at least a short distance beyond the proximal face of the ring 24. The wrapper member 30 is also spaced radially a short distance beyond the circumferential outer surface of the ring 24 and defines a small clearance 32, in this embodiment, about one-half inch. One or more wiper bars 34 are attached onto the outer surface of the sliver ring 24 and sweep through the clearance 32 to move any debris from it. In this embodiment, there are two such siper bars 34 spaced at 180°.

A special sliver bedknife assembly 36 is attached onto the cover, e.g. onto the front frame 26, and is disposed vertically as shown in FIG. 3. The sliver bedknife assembly 36 extends vertically upwards from a trailing end of the wrapper member 30, i.e. the right end in FIG. 3. The bedknife assembly 36 extends along a portion of a chord across the face of the disc 11, and extends to a level equal to or above the top end of the main, stationary bedknife 25. As better shown in FIG. 5, the silver bedknife assembly 36 is formed of a bedknife support or holder 37 preferably welded onto the cover lower portion 16, and a bedknife member 38 fastened onto it. A shim 39 and clamping screw 40 permit adjustment of a small clearance 41 between the distal edge of the bedknife member 38 and the plane at which are disposed the edges 27 of the knife assemblies 22. The clearance 41 should be selected at about 0.010 inches or slightly greater, but normally no more than 0.100 inches and in this case the clearance 41 is set at 0.020 inches. As shown in FIG. 3, the sliver bedknife assembly 36 and the main, stationary bedknife 25 are angled somewhat from a true parallel, and have a spacing of at least several inches between them. Preferably, the sliver bedknife assembly 36 should be between about six and twenty-four inches following the bedknife 25.

The effect of the sliver ring 24, the arcuate wrapper member 30 and the sliver bedknife assembly 36 is to limit the horizontal progress of slivers 28 that emanate from the trailing side of the log 19. The special sliver bedknife assembly 36 serves to block the slivers and cause them to twist, bow, or buckle, so that the slivers are trimmed by the knife assemblies 22, e.g. at the position of the main bedknife 25. By limiting the maximum length thereof, the slivers 28 are prevented from balling up or wrapping around equipment. Additionally, the sliver bedknife 37 cooperates with the disc knives 27 to trim off slivers into short pieces as they are formed. The slivers can be removed or ducted out separately from the chips, as they tend to form at the forward or proximal side of the disc. However, these slivers can also be exhausted with the chips, if desired, and used in a paper pulping process or the like. The trimmed slivers can be easily separated out from the chips, using standard classification equipment.

The invention is not limited to vertical disc chippers of this type where the spout is positioned below the shaft. The invention also pertains to other vertical disc chippers as well as to inclined or horizontal disc chippers Also, while in this embodiment, the ring 24 is continuous, in other possible embodiments, gaps may be prevented. Moreover, the bedknife 25 and/or the sliver bedknife need not be strictly linear, but may have a curved or wavy edge in some other possible embodiments.

While this invention has been described in detail with reference to a preferred embodiment, it should be understood that the invention is not limited to that embodiment. Rather, many modifications and variations would present themselves to those skilled in the art without departing from the scope and spirit of this invention, as defined in the appended claims.

What is Claimed is:

1. A rotary disc type chipper for cutting wood chips from a log fed into it, comprising:

a rotating cutting disc which rotates about an axis and which includes a plurality of generally radially disposed cutting knife assemblies secured to a proximal face of the disc, each cutting knife assembly being disposed adjacent to an opening of a respective chip slot that passes axially through the disc, said knife assemblies having cutting edges disposed in a predetermined cutting plane;

a cover disposed over said disc and having a front member disposed parallel to and spaced from the proximal face of the disc;

a feed chute for bringing logs through a feed port in said cover into contact with said cutting knives assemblies, with said disc rotating said cutting knife assemblies in one direction across said feed port from a leading to a trailing side thereof, and including a stationary bedknife disposed generally radially at the trailing side of said feed port and spaced a predetermined clearance from the cutting plane of said knife assemblies;

a sliver ring mounted on the proximal face of said disc and radially surrounding said cutting knife assemblies, having a proximal face disposed substantially at the cutting plane of said knife assemblies, an arcuate wrapper member mounted on said cover front member and concentric with said sliver ring, said wrapper member extending circumferentially in said one direction from an angular position substantially corresponding to said stationary bedknife for a predetermined distance along the circumferential surface of said sliver ring and extending axially towards said disc and beyond the proximal face of said sliver ring to define a radial gap therebetween of a predetermined clearance; and a sliver bedknife mounted at the front member facing said disc and extending from said wrapper member across said sliver ring and across at least a portion of the proximal surface of the disc, said sliver bedknife having a distal edge disposed at a predetermined small clearance from the cutting plane of said knife assemblies;

wherein said sliver bedknife and said wrapper cooperate with said sliver ring and said knife assemblies to limit the progress of slivers formed at a portion of said log adjacent said stationary bedknife.

2. The chipper of claim 1 wherein said rotary disc is a vertical disc with said axis being disposed horizontally.

3. The chipper of claim 2 wherein said feed port is situated below said axis.

4. The chipper of claim 1 further comprising at least one wiper bar mounted on the circumferential outer surface of said sliver ring to sweep out said gap between the sliver ring and said arcuate wrapper.

5. The chipper of claim 2 wherein said sliver bedknife is disposed vertically.

6. The chipper of claim 4 wherein said sliver bedknife is disposed about six to twenty-four inches beyond the stationary bedknife.

7. The chipper of claim 1 wherein said sliver bedknife includes a bedknife member, a bedknife holder affixed onto said cover front member on a trailing side of the bedknife and adjustable attachment means permitting axial adjustment of said bedknife member relative to said cover front member.

* * * * *